US006322243B1

(12) United States Patent
Bull

(10) Patent No.: US 6,322,243 B1
(45) Date of Patent: Nov. 27, 2001

(54) REVERSING ROTATORY SHAKER MOVEMENT

(76) Inventor: Daniel Bull, 403 N. Fullerton Ave., Upper Montclair, NJ (US) 07043

( * ) Notice: Subject to any disclaimer, the term of this patent is extended or adjusted under 35 U.S.C. 154(b) by 0 days.

(21) Appl. No.: 08/252,341

(22) Filed: Jun. 1, 1994

(51) Int. Cl.[7] ..... B01F 11/00
(52) U.S. Cl. ..... 366/208
(58) Field of Search ..... 366/110–111, 208–217, 366/219

(56) References Cited

U.S. PATENT DOCUMENTS

| | | | | |
|---|---|---|---|---|
| 1,020,344 | * | 3/1912 | Clauson | 366/111 |
| 3,788,611 | * | 1/1974 | Barbini | 366/208 |
| 4,109,319 | * | 8/1978 | Brandt | 366/219 |
| 4,183,677 | * | 1/1980 | de Bruyne | 366/209 |
| 4,571,087 | * | 2/1986 | Ranney | 366/212 X |

* cited by examiner

*Primary Examiner*—Charles E. Cooley

(74) *Attorney, Agent, or Firm*—Law Offices of Mitchell P. Novick; Benjamin Appelbaum

(57) ABSTRACT

A shaker movement permits an arbitrary path of motion in a shaker's shaking action. The shaker movement comprises independent control over the "X" and "Y" directions of the shaking actions by a pair of track assemblies, each track assembly comprising a pair of fixed rods and a pair of sliding rods that are interconnected with each other in a rectangular, grid-like pattern. Motion in both directions can be driven by a single motor utilizing independent pulley-and-belt systems or by two synchronized motors which are connected to a sliding rod of each track assembly. By altering the relative amplitude, phase angle, and frequency between the "X" and "Y" directions, the shaking action can follow a desired path. The shaker path can be varied from the traditional circular orbital motion or linear motion, to a new group of shaking patterns in which the direction of the shaking movement can reverse. The new patterns of shaker movement cause the liquid being shaken to be more thoroughly mixed, with less power input, and at a lower angular frequency than is practical with traditional paths of motion. This results in higher rates of gas transfer to and from the liquid, resulting in greater growth of a bacterial culture, and for higher rates of mass transfer at equivalent levels of energy input.

6 Claims, 8 Drawing Sheets x=sin (ωt), y=cos (2ωt/3)

x=sin (ωt), y=cos (ωt/2)

x=sin (ωt), y=cos (ωt/3)

x=sin (ωt), y=cos (2ωt)

REVERSING ROTATORY SHAKER MOVEMENT

BACKGROUND OF THE INVENTION

1. Field of the Invention

This invention relates to shaking devices for flasks and other containers holding liquid mixtures which are used in biological and other applications, and more particularly to reversing rotatory shakers.

2. Description of the Prior Art

Shakers have been employed for many years for a variety of applications in the chemical, biological, metallurgical, and other industries. Shakers impart a mixing motion to a liquid which is contained in one or more flasks. The flasks, usually made of glass or a polymer, are attached to a platform on the top of the shaker. Because the flasks are so located, they are often referred to as "shake flasks".

Shakers are sometimes enclosed in an environmental chamber held at a controlled temperature. The chamber often becomes an integral part of the shaker, but the device may also be placed in a controlled temperature room. Special lights may be incorporated in the shaker chamber when photosynthesis is desired.

One common application of shakers is to ensure that all components of the liquid are in intimate contact and are well mixed. Another common application is to effectuate mass transfer between liquid and gas by maximizing the boundary contact between these components. For this use, the shake flasks usually comprise Erlenmeyer flasks or some variant of Erlenmeyer flasks. The flask openings are covered with any of a variety of well-known closures which permit free exchange of gases between the flask and the ambient environment. For example, many biological applications require the transfer of oxygen from air to a liquid medium to encourage the growth of microorganisms. Simultaneously, carbon dioxide, a product of metabolism, must be removed from the liquid to prevent accumulation of this gas and inhibition of the growth process.

Prior art shakers accomplish these gas exchanges by imparting an external force to the flask, which in turn creates a vigorous shaking action in the liquid. Most commonly, the shaking action results from the shaker platform being moved in a circular pattern. Increasing the energy applied to the shaker platform increases the rotational speed of the platform and the vigorousness of the shaking action. Regardless, no matter how vigorous the shaking action, the entire body of fluid in the flask still rotates in a single angular direction around the center axis of the flask. Consequently, the motion of one element of liquid relative to another is poor. In fact, due to inertial and frictional considerations, the entire body of fluid tends to rotate as a unit on the walls of the flask. Thus, mixing is accomplished entirely by viscous action, and at high fluid viscosities, the quality of mixing may become quite poor. In short, large amounts of energy must be expended to realize the desired rate of gas exchange in a rotatory shaker.

Various tactics are currently employed to overcome this mixing limitation. One approach involves placing indentations on the walls of the flasks; another involves placing baffles in the flasks. These tactics are often helpful, but they do not solve the underlying problem, which is the mixing limitations inherent in the shaker's basic pattern of motion.

This mixing limitation has been addressed by utilizing a shaker platform motion that is a simple back-and-forth or reciprocating action. Reciprocating shakers can sometimes yield good mixing. However, these reciprocating designs suffer from excessive splashing even at relatively low shaker rates. This splashing is often unacceptable because it results in excessive spillage (from open containers) or contamination (from touching the stopper in closed containers).

Furthermore, there exists a fundamental limitation in these prior art shaker designs that cannot always be overcome either by more vigorous rotatory shaking or tolerating the inherent spillage/contamination in reciprocating shaking. In some instances, it is not possible to exchange gases rapidly enough, and the flask becomes "mass transfer limited". Such operations are not reproducible. Thus, they may yield unreliable results.

An improved method of shaking which would overcome this and other problems associated with present shaker designs is desirable.

In short, prior art shaker designs offer either a circular motion or a linear reciprocating motion. The motion is always in a plane, and the plane is usually, but not necessarily, horizontal. All current designs frequently run at the limits of their capabilities.

SUMMARY OF THE INVENTION

A primary object of the instant invention is a rotatory shaker movement that permits shakers to utilize shaking motions other than circular or linear reciprocating.

Another object of this invention is a rotatory shaker movement that allows for more rapid mass transfer rates, thus overcoming "mass transfer limited" problems.

Another object of this invention is a rotatory shaker movement that produces better mixing at lower inputted energy levels.

Another object of this invention is a rotatory shaker movement that accommodates changeable shaking motions.

In short, this invention is a rotatory shaker movement which independently controls the horizontal and vertical motions of a shaker platform. The combination of these independent movements can produce an arbitrary path of motion in the shaking action, including, if desired the traditional circular and linear reciprocating ones. Thus, the shaking action can be optimized for each type of mixing application. The liquid being shaken can be more thoroughly mixed, with less power input, and at a lower angular frequency than is practical with prior art shakers. Also, this invention allows higher rates of mass transfer at equivalent levels of energy input.

DESCRIPTION OF PREFERRED EMBODIMENT

Figure 1:
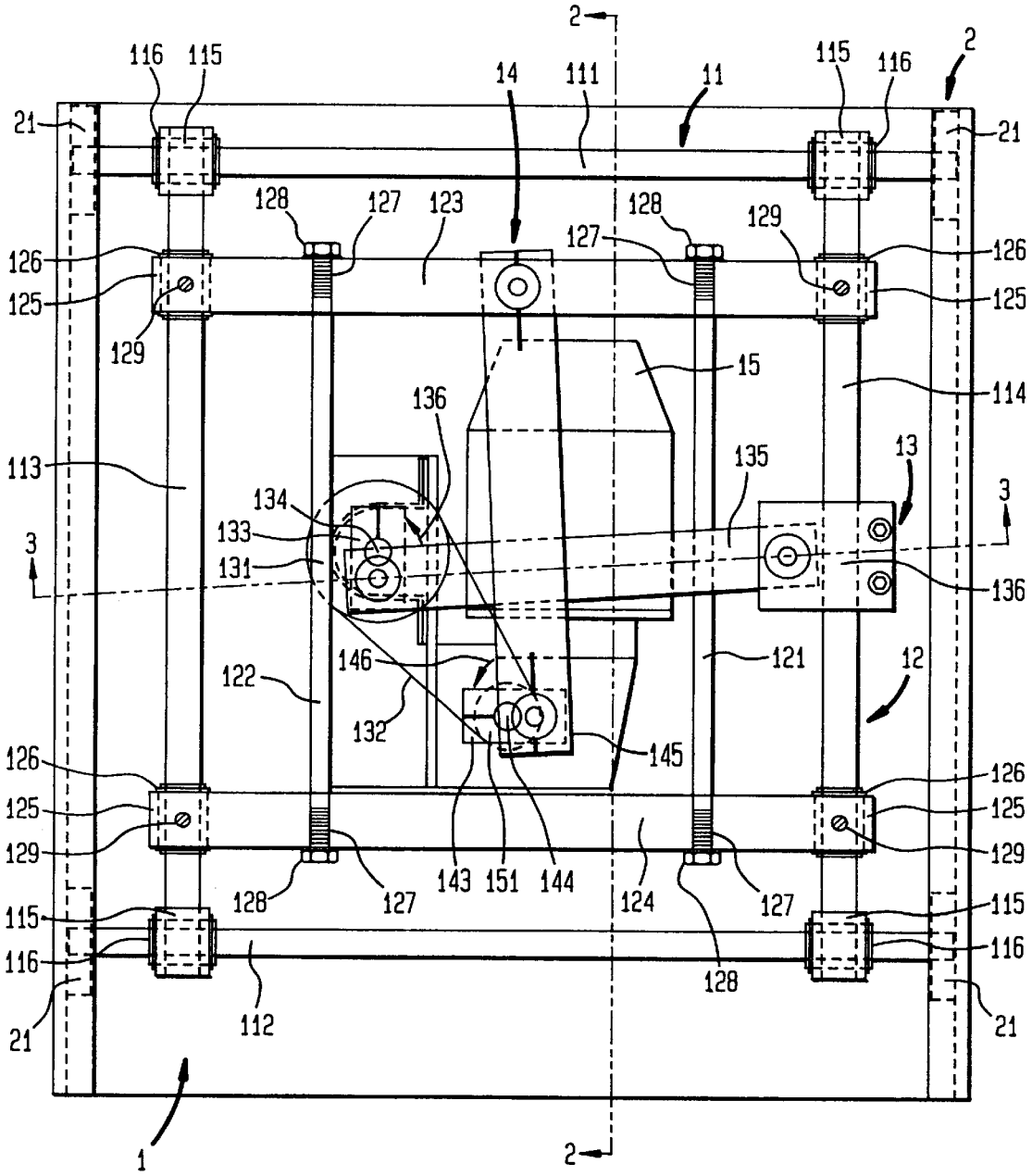
FIG. 1 is a top view of the reversing rotatory shaker movement.
Figure 2:
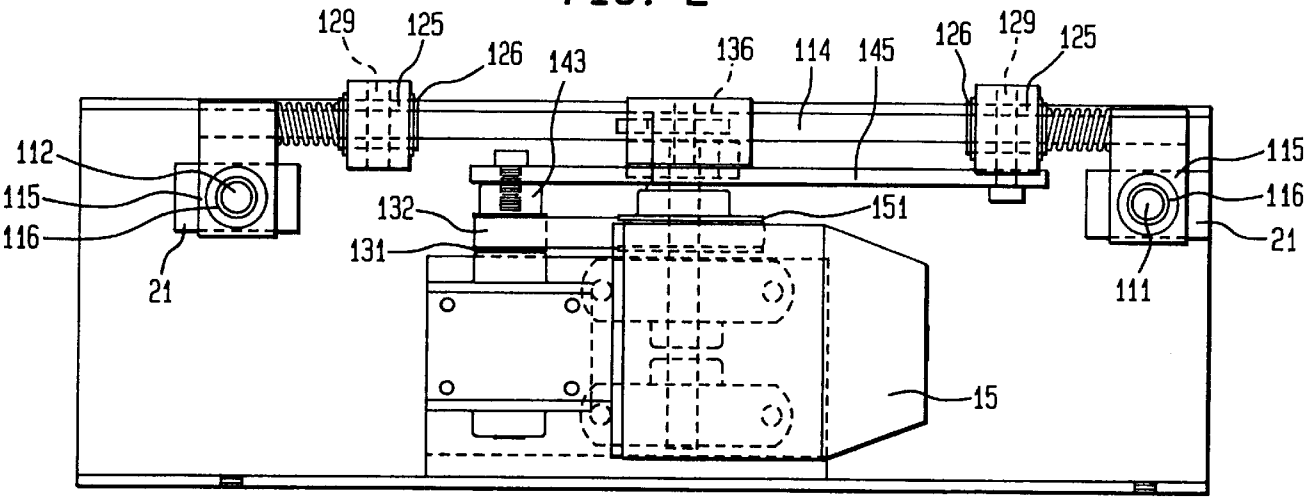
FIG. 2 is a cross-sectional view of the reversing rotatory shaker movement shown in FIG. 1 along line 2—2.
Figure 3:
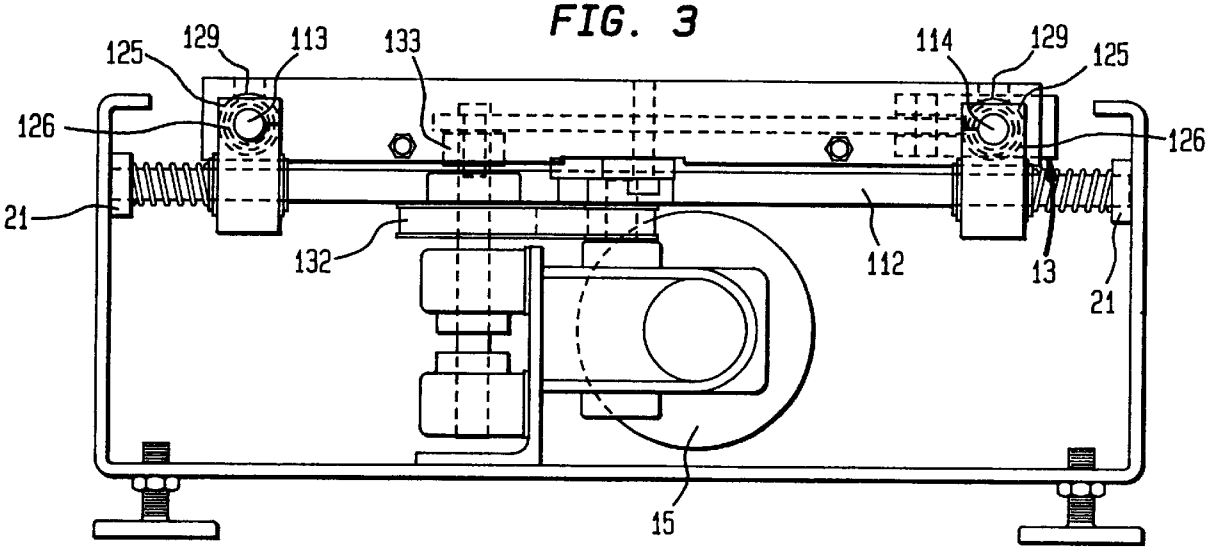
FIG. 3 is a cross-sectional view of the reversing rotatory shaker movement shown in FIG. 1 along line 3—3.
Figure 4:
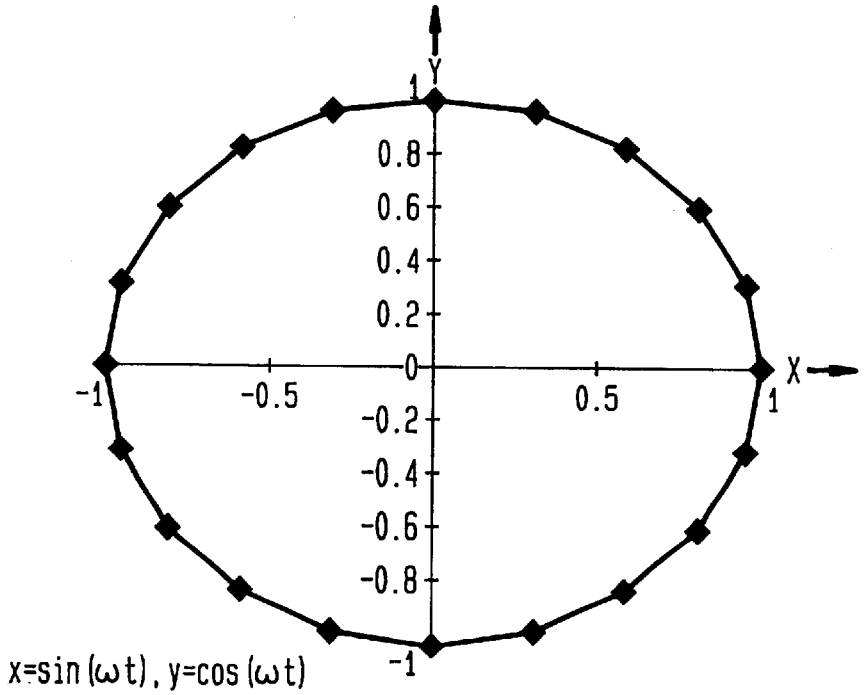
FIG. 4 is a representative plot of a motion path producible by the reversing rotatory shaker movement where the ratio of frequencies is 1:1—$x=\sin(\omega t)$, $y=\cos(\omega t)$.
Figure 5:
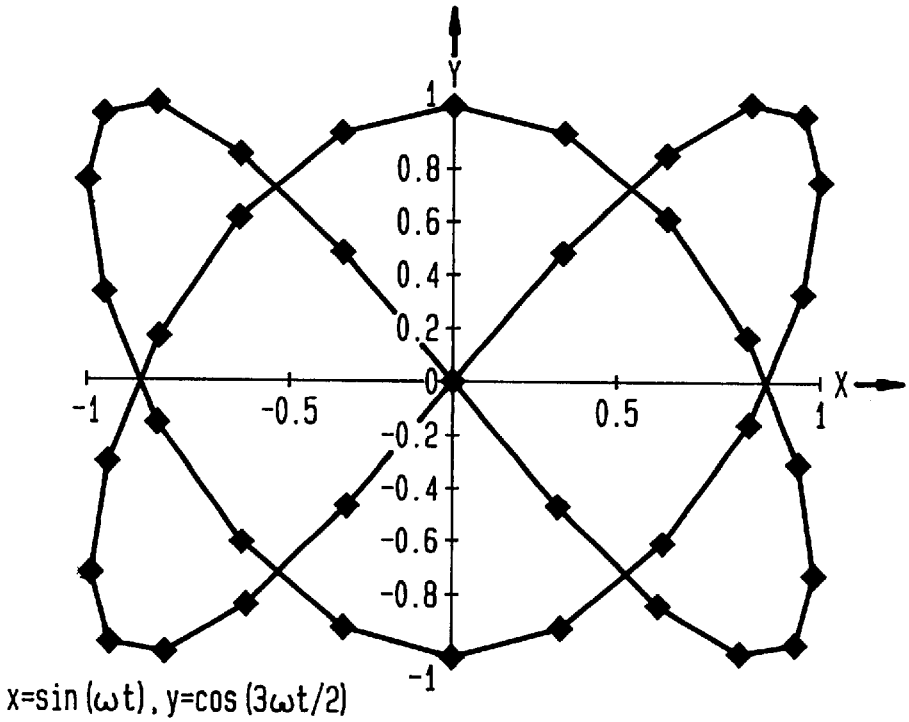
FIG. 5 is a representative plot of a motion path producible by the reversing rotatory shaker movement where the ratio of frequencies is 2:3—$x=\sin(\omega t)$, $y=\cos(3\omega t/2)$.
Figure 6:
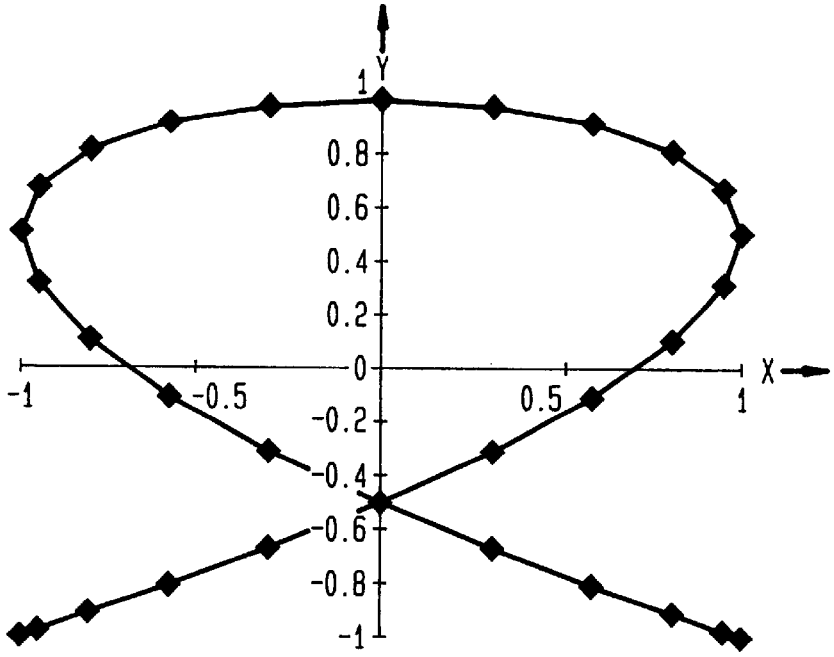
FIG. 6 is a representative plot of a motion path producible by the reversing rotatory shaker movement where the ratio of frequencies is 3:2—$x=\sin(\omega t)$, $y=\cos(2\omega t/3)$.
Figure 7:
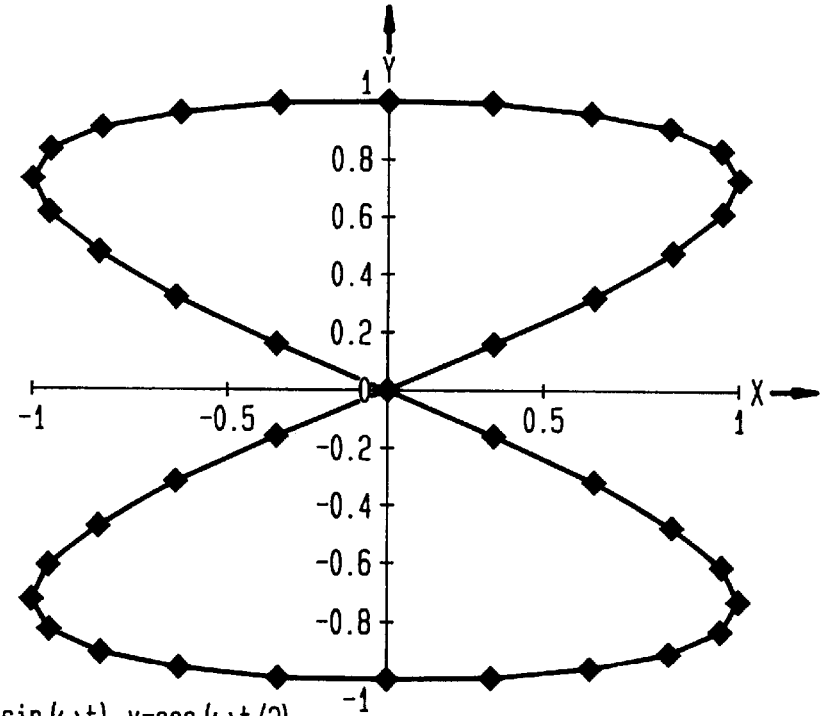
FIG. 7 is a representative plot of a motion path producible by the reversing rotatory shaker movement where the ratio of frequencies is 2:1—$x=\sin(\omega t)$, $y=\cos(\omega t/2)$.
Figure 8:
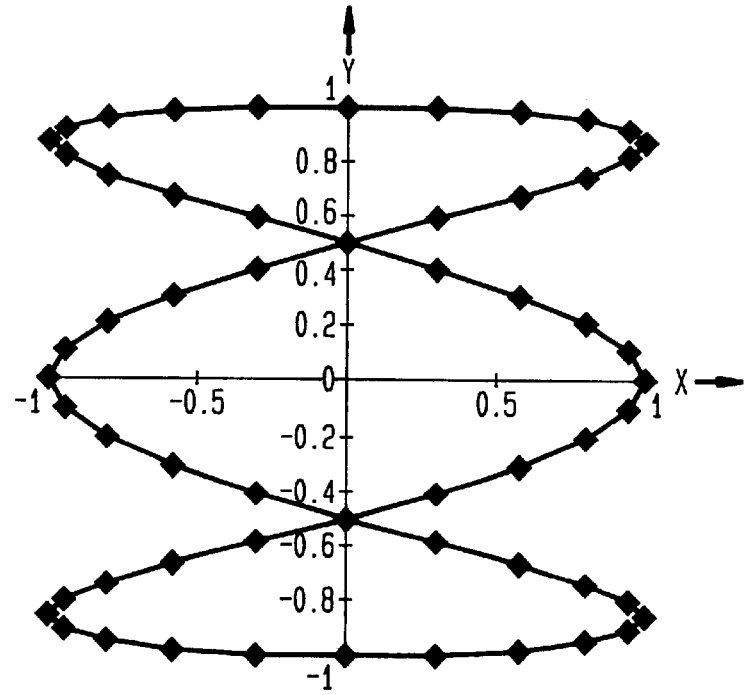
FIG. 8 is a representative plot of a motion path producible by the reversing rotatory shaker movement where the ratio of frequencies is 3:1—$x=\sin(\omega t)$, $y=\cos(\omega t/3)$.
Figure 9:
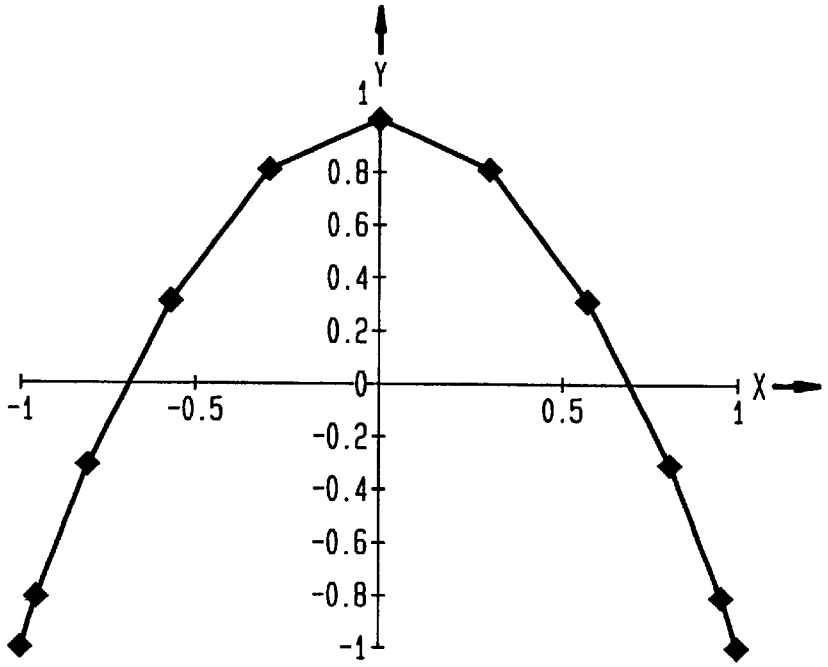
FIG. 9 is a representative plot of a motion path producible by the reversing rotatory shaker movement where the ratio of frequencies is 1:2—$x=\sin(\omega t)$, $y=\cos(2\omega t)$.

In its preferred embodiment, the rotatory shaker movement 1 for use inside a shaker frame 2 comprises two linear motion track assemblies: a first linear motion track assembly 11 and a second linear motion track assembly 12. The two track assemblies 11, 12 are co-planar, but oriented orthogonal, to each other.

Each track 11, 12 is preferably manufactured from hardened steel cylindrical rods 111, 112, 113, 114, 121, 122, 123, 124 to prevent rod bending and length changes that can effect the operation of the shaker movement.

The first track 11 has two fixed rods 111, 112 which are secured to the frame of the shaker 2 preferably by large socket head screws 21 made of steel. This track 11 also has two sliding rods 113, 114 which are oriented orthogonally to the fixed rods 111, 112 with one end attached to each of the fixed rods via a slider block 115. The slider block 115 comprises a structure made of aluminum having an opening the diameter of which is larger than the outer diameter of the fixed rods 111, 112. The opening inside the slider block 115 has a bushing 116 made from a durable, but low-friction substance to provide a tight fit around the fixed rods 111, 112 but permitting the sliding rods 113, 114 to slide with minimal force along the fixed rods 111, 112. Preferably, the bushing 116 is one of the well-known UHMW polyethylenes (ultra-high molecular weight) or similar low-friction polymer. Alternatively, a linear ball bearing structure may be used as the low-friction liner; linear ball bearing use is well known in the prior art. Thus, the sliding rods 113, 114 slide along the fixed rods 111, 112 easily and with minimal shimmying. Hereinafter, the direction of movement of the sliding rods 113, 114 of this first track 11 will be referred to as the "X" direction.

The "X" direction motion is controlled by a crank mechanism 13. The crank mechanism 13 is driven by a single variable speed DC motor 15 via a system of pulleys and belts. The motor 15 has a metal drive shaft timing pulley 151 rigidly connected to the motor's drive shaft. A metal crank timing pulley 131 is rotatably connected to the bottom of the shaker 2. The drive shaft timing pulley 151 is connected to the crank timing pulley 131 via an elastomer timing belt 132. Preferably, crank timing pulley 131 has a diameter twice that of the drive shaft timing pulley 151.

The crank timing pulley 131 is connected to an aluminum crank 133 via a well-known slot-and-key combination 134. The crank 133 is further pinned to an aluminum connecting rod 135. The slot-and-key 134 allows for variable positioning of the crank 133 to adjust the angle formed between the crank 133 and the connecting rod 135. The connecting rod 135 is pinned to a clamping mechanism 136; the clamping mechanism 136 surrounds and is frictionally attached to a portion of sliding rod 114; such frictional attachments are well-known in the prior art.

The second track 12 also has two fixed rods 121, 122 which are threaded at all ends and two sliding rods 123, 124 oriented orthogonally to the fixed rods 121, 122. The fixed rods 121, 122 pass through circular openings 127 in the sliding rods 123, 124, and are secured to these sliding rods 123, 124 preferably by steel hex nuts 128. This track 12 also has two sliding rods 123, 124 which are oriented orthogonally to the first track sliding rods 113, 114 with one end attached to each of these sliding rods 113, 114 via a slider block structure 125. These slider blocks 125 are constructed similarly to slider blocks 115, with a similar low-friction bushing 126. Thus, the second track sliding rods 123, 124 slide along the first track slider rods 113, 114 easily and with minimal shimmying in a direction orthogonal to the "X" direction. Hereinafter, the direction of movement of the sliding rods 123, 124 of this second track 12 will be referred to as the "Y" direction.

The "Y" direction motion is also controlled by a crank mechanism 14. The crank mechanism 14 is driven by the same motor 15 directly off the drive shaft timing pulley 151. The drive shaft timing pulley 151 is connected to an aluminum crank 143 via a well-known slot-and-key combination 144. The crank 143 is further pinned to an aluminum connecting rod 145. The slot-and-key 144 allows for variable positioning of the crank 143 to adjust the angle formed between the crank 143 and the connecting rod 145. The connecting rod 145 is pinned to directly to sliding rod 111.

Each of the slider blocks 125 has in its top surface a platform hole 129, a threaded screw hole to permit secure attachment of a flat, top-mounted shaker platform via screws. To further accommodate such attachment, the slider blocks 125 are preferably share common, flat top surfaces with sliding rods 123, 124; furthermore, the slider blocks 125 may be integral to sliding rods 123, 124.

In use, the desired shaker motion is first described utilizing the well-known description of a path in a plane by specifying an "X" coordinate position and a "Y" coordinate position as a function of "T", the time. Completely arbitrary motion can be achieved by controlling amplitude, phase angle, and frequency. (The subtractive difference between the magnitude of angles 136, 146 when the "X"-direction motion is at one extreme of its travel is commonly known as the "phase angle".) The preferred embodiment, however, utilizes paths that result from altering the frequency but having a phase angle of $\pi/2$ radians (90°) and restricting the amplitude in each direction as a function of time to a sinusoidal waveform of fixed maximum amplitude, which is the same in the "X" and "Y" directions. Preferably, the frequencies of motion in each direction are expressed as a ratio of integers; but obviously, other ratios are possible. It can be easily seen that in the special case X=0 or Y=0 (movement in one direction not changing with time), the motion degenerates to simple translational mode. In the special case where X and Y have equal amplitudes and equal frequencies, the motion follows a circular path. FIGS. 4 through 9, inclusive, illustrate some sample motion patterns producible by the reversing rotatory shaker movement.

Illustratively, to produce the motion described by $X=\sin(\omega t)$, $Y=\cos(\omega t/2)$ (see FIG. 7), the angles 136, 146 respectively between crank 133 and connecting rod 135 and crank 143 and connecting rod 145 are set so that the connecting rods 135, 145 are out of phase by exactly $\pi/2$ radians (90°) when the "X" direction motion is at one extreme of its travel (phase angle of $\pi/2$ radians). This implementation will result in the "figure-8" motion shown in FIG. 7.

Next, the motor 15 is connected to a power source, typically commutated AC line voltage and a well-known motor controller which allows for reading and adjusting the motor speed. A shaker platform made of plastic or lightweight aluminum is connected to the top of the movement 1 by four screws inserted into the platform holes 129.

The motor 15 is then activated, thereby turning the drive shaft timing pulley 151. This timing pulley 151 in turn directly drives crank mechanism 14, which moves the second track assembly 12 reciprocatingly in the "X" direction, and via the timing belt 132, drives crank mechanism 13, which drive the first track assembly 11 reciprocatingly in the "Y" direction. Because of the 1:2 relationship between the timing pulley diameters, the "X" direction movement occurs at frequency ω, the "Y" direction movement at frequency ω/2, or a frequency ratio of 2:1.

Altering the phase angle by changing angles 136, 146 results in a change in the path shape. Also, altering the relative sizes of the diameters of the timing pulleys 131, 151 results in changing the relative frequencies of the "X" and "Y" motions, thereby producing a change in the path shape.

Further variation of the shaker motion of the device could be obtained by varying the relative lengths of the cranks 133, 143, thereby changing the relative amplitudes of the translational motions along the tracks 11, 12, and thus changing the relative amplitudes of the "X" and "Y" motions. As the amplitude ratio becomes very large, the motion approaches purely linear in the direction with the larger amplitude (the X=0 or Y=0 described above).

The shaker movement 1 is then incorporated into a shaker setup that utilizes the present standard shaker equipment including prior art shaker enclosures, controls, platform, and shake flasks. The flasks containing liquid to be mixed are placed on the shaker platform. The shaker is activated at the desired speed and let run for the desired length of time. Once the shaker setup is assembled incorporating the instant invention, use of the shaker is the same as in prior art shakers.

Figure 10:
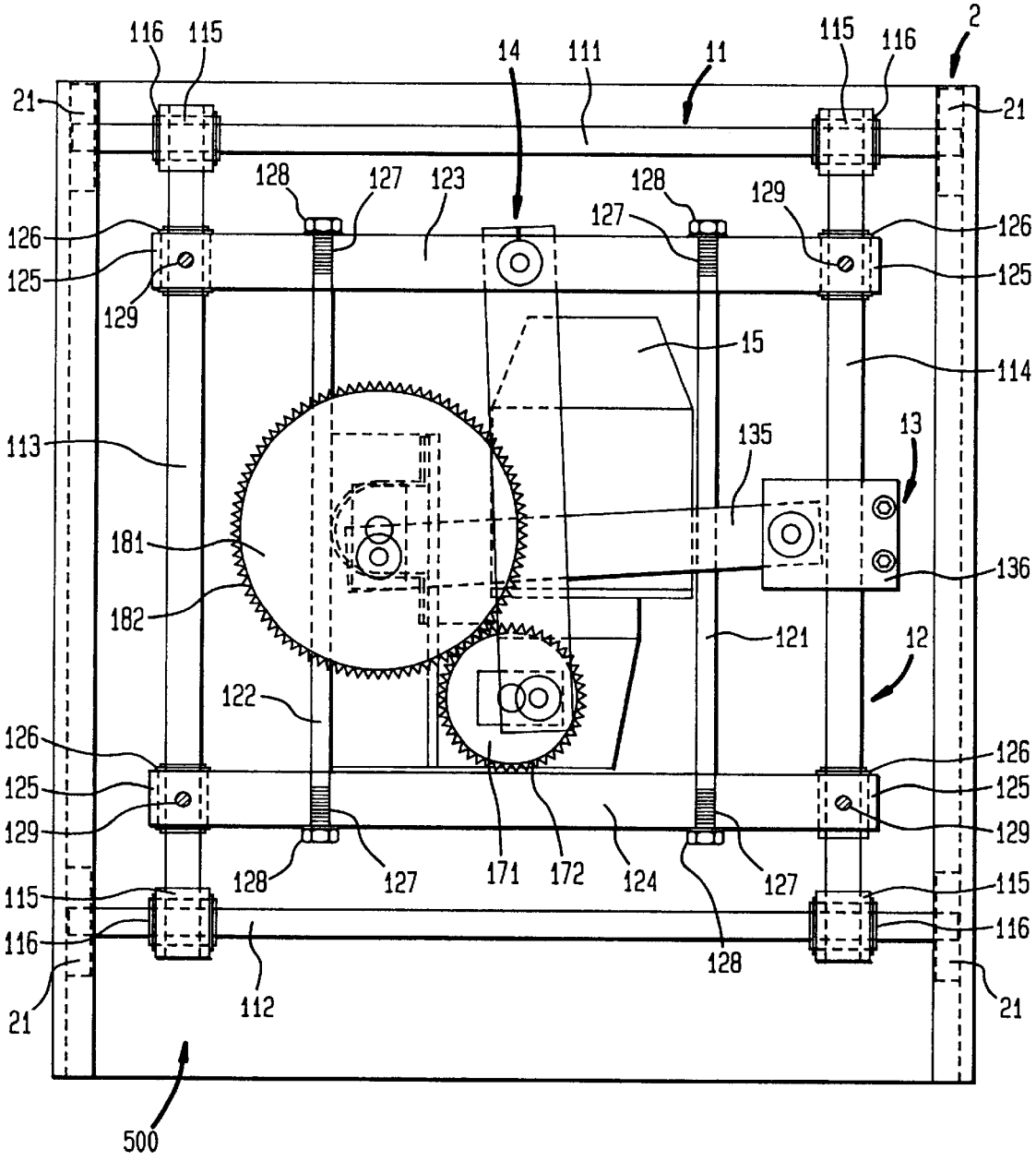
FIG. 10 is a top view of the reversing rotatory shaker movement comprising a system of gears.
Figure 11:
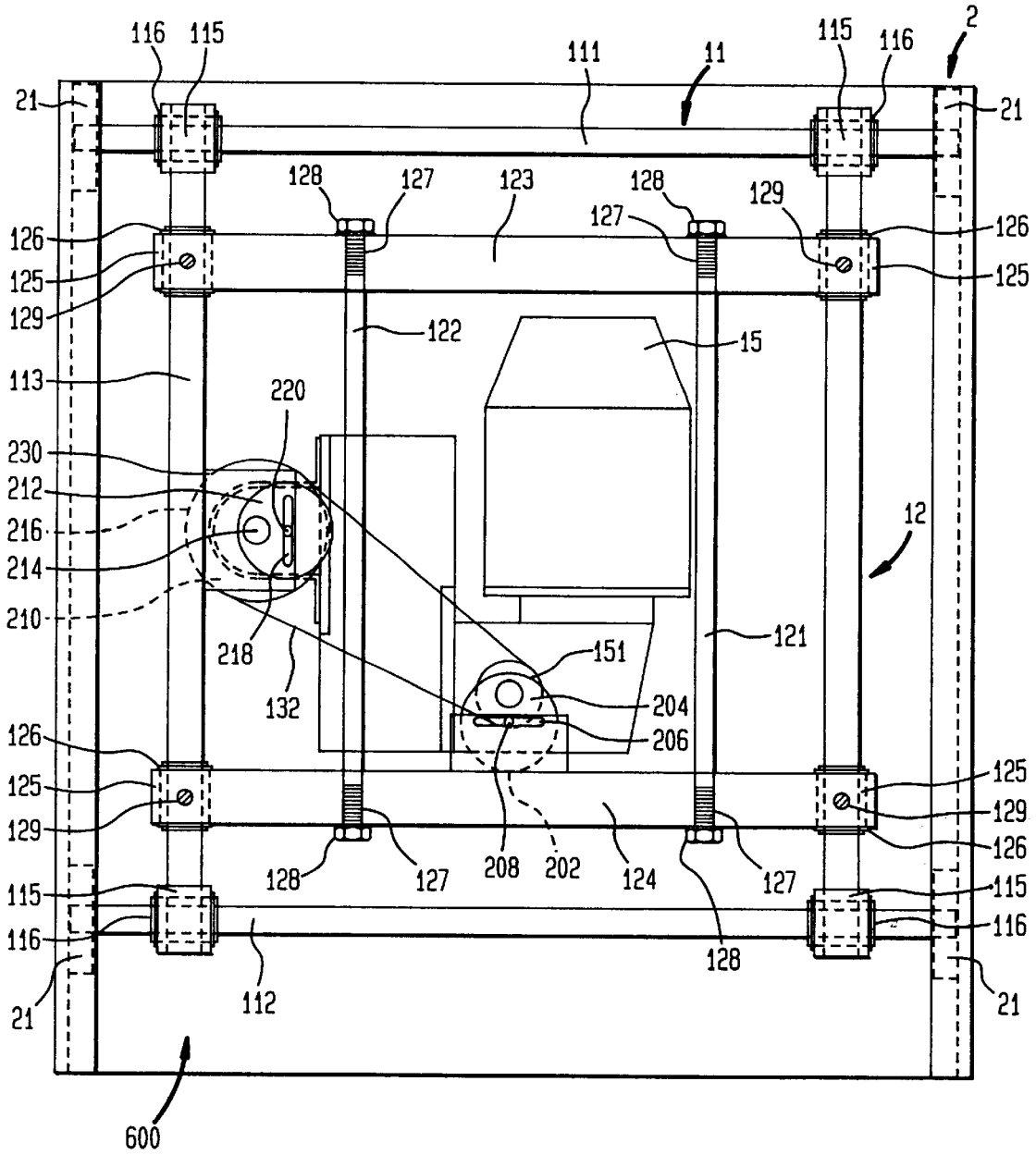
FIG. 11 is a top view of the reversing rotatory shaker movement comprising a system of cams and slot plates.

An embodiment of the present invention shown in FIG. 10 comprises a shaker movement 500 in which the cranks are driven by a system of gears. A metal drive gear 171 having a plurality of teeth 172 on its outer surface is rigidly mounted on the drive shaft 152 of motor 15. A metal driven gear 181 having a plurality of teeth 182 is rotatably connected to the bottom of the shaker 2. The drive gear 171 and driven gear 181 are positioned such that their teeth engage and drive the shaker movement. Preferably, the pitch diameter of driven gear 181 is twice that of drive gear 171. Another embodiment comprises a system of cams and slot plates to drive the shaker movement 600 (FIG. 11). Rod timing pulley 210 and cam 212 are rotatably mounted on a shaft 214 rotatably connected to the bottom of shaker 2. Cam 202 is mounted on the drive shaft 152 of motor 15. Shaft timing pulley 151, mounted on drive shaft 152 of motor 15, is connected to rod timing pulley 210 via an elastomer timing belt 132. Slot plate 204 is attached to cam 202 via pin 208. Slot plate 204 contains a central slot 206 which is disposed around pin 208, such that slot plate 204 slides along pin 208.

Slot plate 216 contains a central slot 218 disposed around pin 220, such that slot plate 216 slides along pin 220. Pin 220 is rigidly attached to cam 202.

The rotation of cam 202 causes slot plate 204 to slide along pin 206, cam 202 contacting sliding rod 124, and cam 202 thereby driving sliding rod 124 in the "Y" direction. Belt 132 drives rod timing pulley 210 and cam 212. The rotation of cam 212 causes slot plate 216 to slide along pin 220, cam 212 contacting sliding rod 113, and cam 212 driving sliding rod 113 in the "X" direction. Cams 202 and 212 can be similar, and are offset by N/2 where N is the diameter of the shaker orbit.

Figure 12:
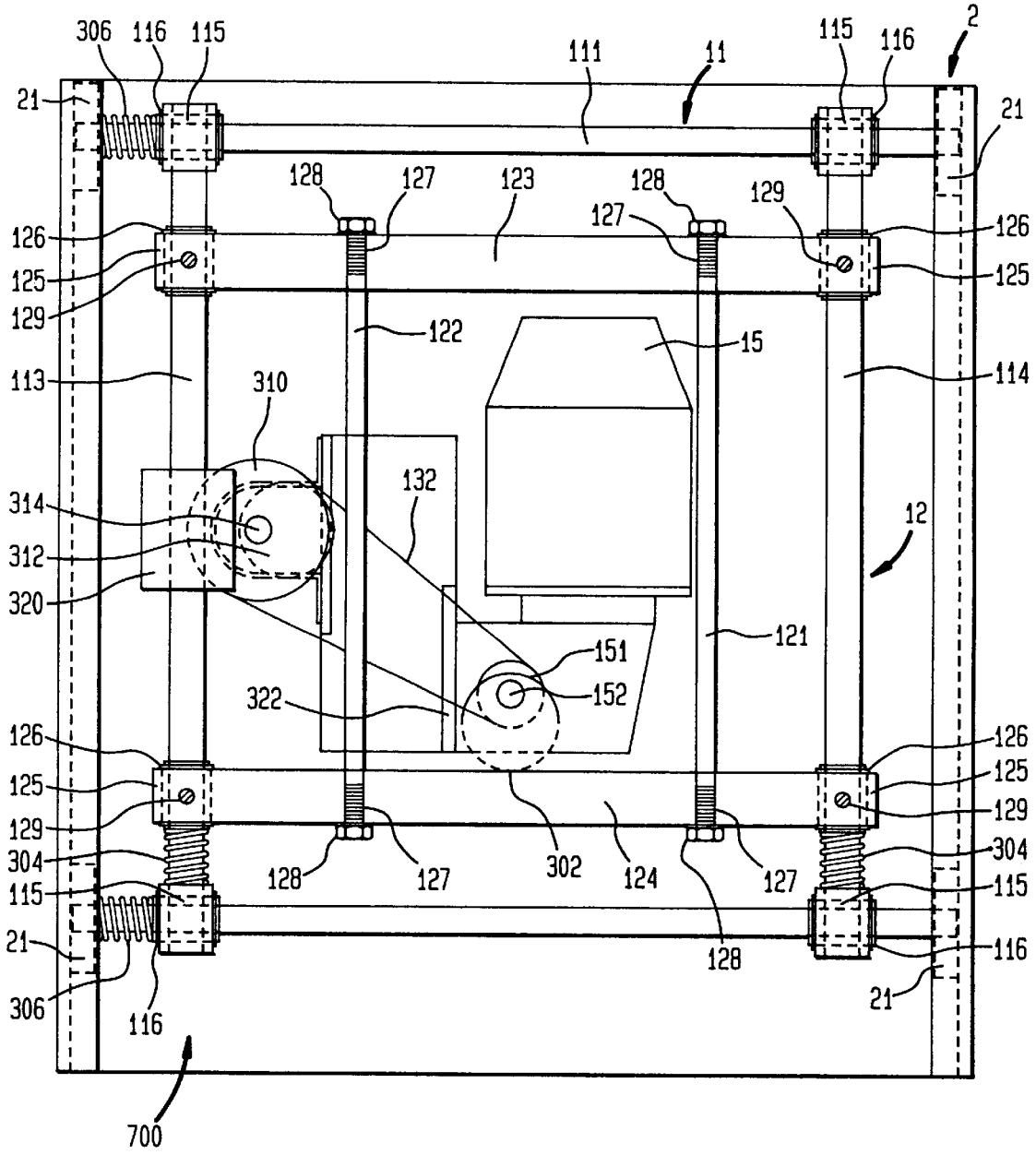
FIG. 12 is a top view of the reversing rotatory shaker movement comprising a system of cams and springs.

A further embodiment comprises a system of cams and springs to control shaker movement 700 (FIG. 12). Cam 302 is rigidly mounted on the drive shaft 152 of motor 15. A coiled return spring 304 is disposed around an end of each of sliding rods 113 and 114 between slider blocks 115 and 125, respectively. A second pair of coiled return springs 306 is disposed around an end of fixed rods 111 and 112, between slider block 115 and shaker frame 2.

Block 320 is rigidly mounted on rod 113 so that they will move as one unit. Rod timing pulley 310 and cam 312 are rotatably mounted on shaft 314. Cam 312 makes frictional contact with block 320. Shaft timing pulley 151 is mounted on drive shaft 152 of motor 15. Drive shaft timing pulley 151 is connected to rod timing pulley 310 via an elastomer timing belt 132. The rotation of cam 302 causes it to contact sliding rod 124, and to urge bushings 126 against springs 304, thereby driving the shaker movement in the "Y" direction. Springs 304 become compressed during the urging of the shaker movement in the "Y" direction, and as cam 302 rotates away from sliding rod 124 springs 304 decompress and cause sliding rod 124 to return to its prior position. Belt 132 drives rod timing pulley 310 and cam 312. The rotation of cam 312 causes cam 312 to contact block 320, and to urge bushings 116 against springs 306, thereby driving the shaker movement in the "X" direction. Springs 306 become compressed during the urging of the shaker movement in the "X" direction, and as cam 312 rotates away from block 320 and sliding rod 113 springs 306 decompress and cause sliding rod 113 to return to its prior position. Cams 302 and 312 are similar, and are offset by N/2, where N is the diameter of the shaker orbit.

All of these paths result in a reversal of the direction of motion in the X,Y plane. The sense of the motion alternates repeatedly between clockwise and counterclockwise. Periodic reversal of the direction of motion forces the liquid in the flasks on the shaker platform to undergo an abrupt change of velocity relative to the flask in which it is contained. The outcome is higher shear forces in the liquid, which leads to better mixing. On average, each element of liquid moves from the surface to the interior of the liquid more readily than with prior art shakers. The higher shear forces also encourage each liquid element to break up and recombine with other elements more easily. Thus, there is improved mixing, increased turbulence, and superior gas-to-liquid mass transfer.

SAMPLE EXPERIMENTAL RESULTS

The results of using this invention were compared against a prior art conventional rotary movement shaker growing a strain of *Bacillus subtilis*. This organism has a relatively high demand for oxygen. The experimental conditions were:

*Bacillus subtilis* sp was used.

Concentrations were 50 ml of media in each 250 ml flask.

All flasks were fitted with cotton plugs.

The optical density of samples were measured with 1:10 dilution.

Ambient temperature was maintained at 25° C.

Experiment 1

Inoculum—5 ml of Washed Slant in Each Flask

In this experiment, both shakers were running at the same speed.

| Time (Hours) | Optical Density @ 590 nm Reversing Shaker (200 RPM) | Prior Art Rotary Shaker (200 RPM) |
|---|---|---|
| 0 | 0.2 | 0.2 |
| 14 | 3.35 | 1.25 |
| 21 | 6.4 | 1.75 |

Experiment 2

Inoculum—5% From Actively Growing Flask

In this experiment the prior art shaker was running at a higher rate than the shaker incorporating the instant invention.

| Time (Hours) | Optical Density @ 590 nm Reversing Shaker (200 RPM) | Prior Art Rotary Shaker (200 RPM) |
|---|---|---|
| 0 | 0.2 | 0.2 |
| 4 | 2.69 | 1.28 |
| 6 | 6.02 | 2.52 |
| 8 | 6.78 | 3.69 |
| 10 | 8.45 | 4.1 |
| 12 | 9.75 | 4.16 |
| 14 | 11.0 | 4.6 |
| 18 | 11.5 | 4.9 |

Experiment 3

Inoculum—10% From Actively Growing Flask

In this experiment, the rate of shaking in the prior art shaker was higher than the previous experiment while the shaker setup incorporating the instant invention was kept at the same shaking rate. The inoculum was also increased to 10%.

| Time (Hours) | Optical Density @ 590 nm Reversing Shaker (200 RPM) | Prior Art Rotary Shaker (200 RPM) |
|---|---|---|
| 0 | 0.2 | 0.2 |
| 2 | 0.4 | 0.31 |
| 4 | 0.7 | 0.4 |
| 6.5 | 15.0 | 12.0 |
| 8 | 25.0 | 15.0 |

Although this invention has been described with a certain degree of particularity, it is to be understood that the present disclosure has been made only by way of illustration and that numerous changes in the details of construction and arrangement of parts may be resorted to without departing from the spirit and scope of this invention. For example, separate synchronized motors could also be used to drive the cranks, allowing for arbitrary frequency ratios without the need to physically change pulleys. Also, gears could be used instead of belts and pulleys to control the cranks. Cams and slot plates or cams and springs would also be suitable. In fact, use of cams and springs would permit arbitrary amplitude of the shaker motion.

I claim:

1. A shaker movement for a rotatory shaker having a shaker platform, the shaker movement comprising:

(a) a first track assembly defining a first direction;

(b) a second track assembly defining a second direction, the second direction being not parallel to the first direction;

(c) the first direction and the second direction defining a relative angular displacement between the first direction and the second direction;

(d) orientation means to maintain the relative angular displacement between the first direction and the second direction, and to connect one of the track assemblies to a support means;

(e) motor means;

(f) first control means to connect the motor means to the first track assembly;

(g) second control means to connect the motor means to the second track assembly; each track assembly further comprising:

(1) first and second fixed rods oriented parallel to each other;

(2) first and second sliding rods oriented parallel to each other and orthogonally to the fixed rods;

(3) the fixed rods and the sliding rods connected together forming a substantially rigid, rectangular grid-like structure;

(4) crank means having two ends, the crank means connected at one of the ends to the first sliding rod of the corresponding track assembly, and the crank means connected at the other end to the control means associated with the corresponding track assembly; and (h) platform connection means to connect the shaker movement to the shaker platform;

whereby motions of the first and second track assemblies together enable a point on the shaker platform to follow a complex curvilinear path.

2. A shaker movement as described in claim 1 in which the relative angular displacement is 90 degrees.

3. A shaker movement as described in claim 1 in which:

(a) the first control means comprises a first cam, a first pulley attached to the motor means, and plurality of first springs, one of such first springs disposed on each of the fixed rods of the first track assembly such that each such first spring compresses and decompresses in response to the motion of a sliding rod of the first track assembly; and (b) the second control means comprises a second cam, a second pulley attached to the motor means, and a plurality of second springs, one of such second springs disposed on each of the sliding rods of the first track assembly such that each such second spring compresses and decompresses in response to the motion of a sliding rod of the second track assembly.

4. A shaker movement for a rotatory shaker having a shaker platform, the shaker movement comprising:

(a) a first track assembly defining a first direction;

(b) a second track assembly defining a second direction, the second direction being not parallel to the first direction;

(c) the first direction and the second direction defining a relative angular displacement between the first direction and the second direction;

(d) orientation means to maintain the relative angular displacement between the first direction and the second direction, and to connect one of the track assemblies to a support means;

(e) motor means;

(f) first control means to connect the motor means to the first track assembly;

(g) second control means to connect the motor means to the second track assembly, each control means comprising (1) a first timing pulley attached to the motor;

(2) a second timing pulley attached to the corresponding control means; and (3) a timing belt connecting the first and second timing pulleys; and (h) platform connection means to connect the shaker movement to the shaker platform;

whereby motions of the first and second track assemblies together enable a point on the shaker platform to follow a complex curvilinear path.

5. A shaker movement for a rotatory shaker having a shaker platform, the shaker movement comprising:

(a) a first track assembly defining a first direction;

(b) a second track assembly defining a second direction, the second direction being not parallel to the first direction;

(c) the first direction and the second direction defining a relative angular displacement between the first direction and the second direction;

(d) orientation means to maintain the relative angular displacement between the first direction and the second direction, and to connect one of the track assemblies to a support means;

(e) motor means;

(f) first control means to connect the motor means to the first track assembly, the first control means comprising a drive gear attached to the motor means and a crank means connecting the motor means to the first track assembly;

(g) second control means to connect the motor means to the second track assembly, the second control means having a driven gear and a second crank means connecting the second control means to the second track assembly;

the drive gear and the driven gear positioned so as to intermeshingly engage each other; and (h) platform connection means to connect the shaker movement to the shaker platform;

whereby motions of the first and second track assemblies together enable a point on the shaker platform to follow a complex curvilinear path.

6. A shaker movement for a rotatory shaker having a shaker platform, the shaker movement comprising:

(a) a first track assembly defining a first direction;

(b) a second track assembly defining a second direction, the second direction being not parallel to the first direction;

(c) the first direction and the second direction defining a relative angular displacement between the first direction and the second direction;

(d) orientation means to maintain the relative angular displacement between the first direction and the second direction, and to connect one of the track assemblies to a support means;

(e) motor means;

(f) first control means to connect the motor means to the first track assembly, the first control means comprising a first cam, a first pulley attached to the motor means, a first pin attached to the first cam, and a first slot plate translationally surrounding the first pin such that the first slot plate and the first cam are maintained in a relative position to each other;

(g) second control means to connect the motor means to the second track assembly, the second control means comprising a second cam, a second pulley attached to the motor means, a second pin attached to the second cam, and a second slot plate translationally surrounding the second pin such that the second slot plate and the second cam are maintained in a relative position to each other: and (h) platform connection means to connect the shaker movement to the shaker platform;

whereby motions of the first and second track assemblies together enable a point on the shaker platform to follow a complex curvilinear path.

* * * * *